US010018449B2

(12) United States Patent
Baldridge et al.

(10) Patent No.: US 10,018,449 B2
(45) Date of Patent: Jul. 10, 2018

(54) TARGET SYSTEM TRANSMITTING FEEDBACK TO SHOOTER

(71) Applicant: Nthdegree Technologies Worldwide Inc., Tempe, AZ (US)

(72) Inventors: Jeffrey Baldridge, Chandler, AZ (US); Alexander Ray, Tempe, AZ (US); Bradley Whaley, Gilbert, AZ (US); Darin Wagner, Chandler, AZ (US); Neil O. Shotton, Tempe, AZ (US); Richard A. Blanchard, Los Altos, CA (US); Shelby Jueden, Chandler, AZ (US); Steven Roach, Gilbert, AZ (US); Larry Todd Biggs, Queen Creek, AZ (US); Eric Kahrs, Phoenix, AZ (US)

(73) Assignee: Nthdegree Technologies Worldwide Inc., Tempe, AZ (US)

( * ) Notice: Subject to any disclaimer, the term of this patent is extended or adjusted under 35 U.S.C. 154(b) by 247 days.

(21) Appl. No.: 14/994,086

(22) Filed: Jan. 12, 2016

(65) Prior Publication Data

US 2016/0238352 A1 Aug. 18, 2016

Related U.S. Application Data

(60) Provisional application No. 62/115,508, filed on Feb. 12, 2015, provisional application No. 62/149,451, filed on Apr. 17, 2015, provisional application No. 62/249,035, filed on Oct. 30, 2015, provisional application No. 62/259,594, filed on Nov. 24, 2015, provisional application No. 62/160,478, filed on May 12, 2015.

(51) Int. Cl.
*A63B 63/00* (2006.01)
*F41J 5/04* (2006.01)

(52) U.S. Cl.
CPC ..... *F41J 5/041* (2013.01)

(58) Field of Classification Search
USPC ..... 273/371
See application file for complete search history.

(56) References Cited

U.S. PATENT DOCUMENTS

2004/0014010 A1* 1/2004 Swensen ..... F41A 33/02 434/21
2014/0315642 A1* 10/2014 Grant ..... A63F 13/06 463/38

* cited by examiner

*Primary Examiner* — Pierre E Elisca
(74) *Attorney, Agent, or Firm* — Patent Law Group LLP; Brian D. Ogonowsky

(57) ABSTRACT

An active target has a target face that is backlit by LEDs, where a detection layer behind the target face detects a new projectile hole in the target, such as from a gun or an arrow. The detection layer may be formed of one or more resistive layers, and the detected increase in resistance due to a new projectile hole being created is sensed and correlated to an XY position of the hole. The location of the new hole is transmitted via an RF signal to the shooter's portable device, such as a smartphone, and the shooter sees the location of the hit relative to the target face in real time. The LEDs may be dynamically controlled. The target is disposable and is supported by a support base containing the control electronics and transmitter.

28 Claims, 7 Drawing Sheets

TARGET SYSTEM TRANSMITTING FEEDBACK TO SHOOTER

CROSS-REFERENCE TO RELATED APPLICATIONS

This application is based on the following U.S. provisional application Ser. Nos. 62/115,508, filed Feb. 12, 2015; 62/149,451, filed Apr. 17, 2015; 62/160,478, filed May 12, 2015; 62/249,035, filed Oct. 30, 2015; and 62/259,594, filed Nov. 24, 2015, all applications being assigned to the present assignee and incorporated herein by reference.

FIELD OF THE INVENTION

This invention relates to a physical target (as opposed to a video game target), such as for actual gun shooting or archery, and, in particular, to a target system that generates electronic signals to provide feedback to the shooter.

BACKGROUND

When shooting targets, such as with actual bullets or arrows, it is sometimes difficult to see exactly where the projectile entered the target or which hole was caused by the most recent shot.

It is known to use complex and expensive systems to automatically detect the entry points of bullets into a target by optical detection, sound triangulation, or by other techniques that use remote sensing devices to sense the location of the bullet entry point. Such methods entail a fixed and relatively expensive system that uses standard replaceable paper targets. Such systems require extensive calibration. These fixed systems are obviously impractical for many situations.

What is needed is a target feedback system that is less costly than the prior art systems, and where the system can be quickly set up anywhere.

SUMMARY

In one embodiment, a target comprises a target face presenting a target image for the shooter. The target also includes a thin layer of printed light emitting diodes (LEDs) and a projectile hole detection layer behind the target face. The target may have a standard printed face, or the LEDs may be controlled to create the target image. The target, including the LEDs and the detection layer, is on a single flexible substrate such as paper or paper having a laminated plastic surface.

In the simplest embodiment, referred to as a reactive target, a single resistive sheet is located behind the target image. Metal traces on the back of the target electrically connect a DC voltage source across both vertical edges of the resistive sheet. The resistive sheet may be a thin layer of a carbon mixture printed on the target substrate. The fixed DC voltage is periodically applied across the resistive sheet to detect its horizontal resistance. The resistive sheet may form part of a resistor divider, and the current through the resistive sheet is based on the overall horizontal resistance of the resistive sheet. The current creates a voltage drop across a fixed resistor in the resistor divider. Any new projectile hole in the resistive sheet increases the horizontal resistance of the sheet. If there is a lowering of the voltage drop across the fixed resistor greater than a threshold amount, relative to the previous measurement, it signifies that a new hole has been made in the resistive sheet. If the targets are small, hitting the resistive sheet is a maximum score, and the hit is automatically scored by the system. This hit may be accompanied by a light display by an LED layer, also behind the target face. A controller carries out the measurement routine and controls the LED display. A single flexible substrate may include an array of small targets, where each small target has its own resistive sheet and LED layer.

In a more complex embodiment, referred to as a smart target, the projectile hole detecting layer detects the XY position of the new hole and transmits the location of the hole to the shooter.

In one embodiment, two resistive layers overlap and are electrically insulated from one another. The resistive layers may be printed on opposite sides of a single substrate. One resistive layer may form relative wide column lines (wider than a single bullet hole), where the resistance between one end of a column line and the other end of the column line is detected during a scanning sense operation. The other resistive layer may form relatively wide row lines, where the resistance between one end of a row line and the other end of the row line is detected during the scanning sense operation. When a projectile removes a part of a column line and the underlying row line, the location of the change in resistance value (a higher resistance) is detected by scanning the various rows and columns. The intersection of the increased-resistance column and the increased-resistance row corresponds to an XY position on the target. The resistive layers may be printed using an ink containing a resistive material such as carbon.

In another embodiment, a single resistive sheet is formed of a layer having a uniform or varying resistance. The resistive sheet is contacted along its vertical sides, to detect a horizontal resistance across the resistive sheet, and contacted along its horizontal sides, to detect a vertical resistance across the resistive sheet. The removal of a portion of the resistive sheet by a projectile produces a characteristic change in the resistance value in the horizontal and vertical directions, and this change corresponds to an XY position on the target.

In another embodiment, the resistive sheet is contacted at various points along its vertical side and horizontal side and scanned to identify the location of the projectile hole corresponding to the change in resistance.

In another embodiment, the resistive sheet may be formed of a mesh of overlapping resistive row and column lines, where a projectile hole breaks through one or more of the lines and changes a vertical and horizontal resistance of the mesh to uniquely identify the XY location on a target.

Instead of detecting changes in resistances of the resistive layers, changes in capacitance values may be detected to determine the location of the projectile hole.

The detected XY position may cause the system to automatically score the hit and visually identify the hit by the energization of LEDs behind the target.

A reusable programmed controller, removably connected to the detection layer, identifies the location of the new projectile hole in the target. The controller supplies a signal to a transmitter, such as a radio transmitter, that transmits a signal, such as an RF signal, to a programmed smartphone, or other suitable device with a display screen, and the smartphone displays to the shooter the location of the new hole in the target in real time. The smartphone may even be programmed to automatically tally a score. Even if a new projectile hole partially overlaps a previous hole, the system still detects the XY location corresponding to the change in the resistance of the detection layer.

Eventually, after the target becomes sufficiently destroyed by the projectiles, the disposable target is replaced, and the controller and transmitter are connected to a new target.

The LED layer and detection layer may be laminated over the target substrate or the various layers may be directly printed on the target substrate.

Since the LED layer and detection layer may be printed using inks, the target is inexpensive to fabricate. The LEDs may be optional.

The LEDs may be addressable and controlled to create a moving target to increase the shooting challenge. The moving target may take any shape. The controller is programmed to identify any scoring values associated with a particular shot.

In an alternative embodiment, an LED strip is coupled to one or more edges of a flexible waveguide, where light leaks out the front surface of the waveguide. Any target design may be printed on the waveguide or may be printed on a translucent overlay, where the waveguide acts as a backlight. Any removing of a portion of the waveguide by a projectile will be clearly seen by the shooter as a dark spot.

The resulting multi-layered disposable target can be mounted in a reusable rigid frame. The target may be any size. A holder for the frame may contain the permanent circuitry and support the target over the floor or ground or on a wall.

The LED layer and detection layer may be modular so that multiple LED layers and multiple detection layers can be provided on a substrate to build a target of any size.

A 9 volt battery may power the entire system.

The target system may be beneficial to the police, military, or sports shooters for simulating various events.

Other embodiments are disclosed.

BRIEF DESCRIPTION OF THE DRAWINGS

FIG. 6 also illustrates transmitting the location of the new projectile hole to the shooter's portable device.

DETAILED DESCRIPTION

The present invention relates to an electronic target for gun shooting, archery, darts, or other activity where projectiles penetrate a target surface. In some embodiments, automatic feedback of the position of the projectile's hole in the target is transmitted to a portable device, such as a smartphone or a tablet, in real time. The portable device may also be programmed to tally the shooter's score. The system may also identify the time between shooting events, such as the time between a target being "active" and the first hit of the target or the time between hits. Other functions are described.

In one embodiment, an addressable LED light sheet is used for designating an active target location, which may be dynamically changed to create a moving target. The LED light sheet may also be used for uniformly backlighting the target and for visually highlighting a hit in the target.

The present assignee has previously invented a flat light sheet formed by printing microscopic inorganic (GaN) vertical LED dice over a conductor layer on a flexible substrate film to electrically contact the LED's bottom electrodes, then printing a thin dielectric layer over the conductor layer which exposes the LED's top electrodes, then printing another conductor layer to contact the LED's top electrodes to connect them in parallel. Either or both conductor layers may be transparent to allow the LED light to pass through. The LEDs may be printed to have a large percentage of the LEDs with the same orientation so the light sheet may be driven with a DC voltage. The light sheet may have a thickness between 5-13 mils, which is on the order of the thickness of a sheet of paper or cloth.

Figure 1:
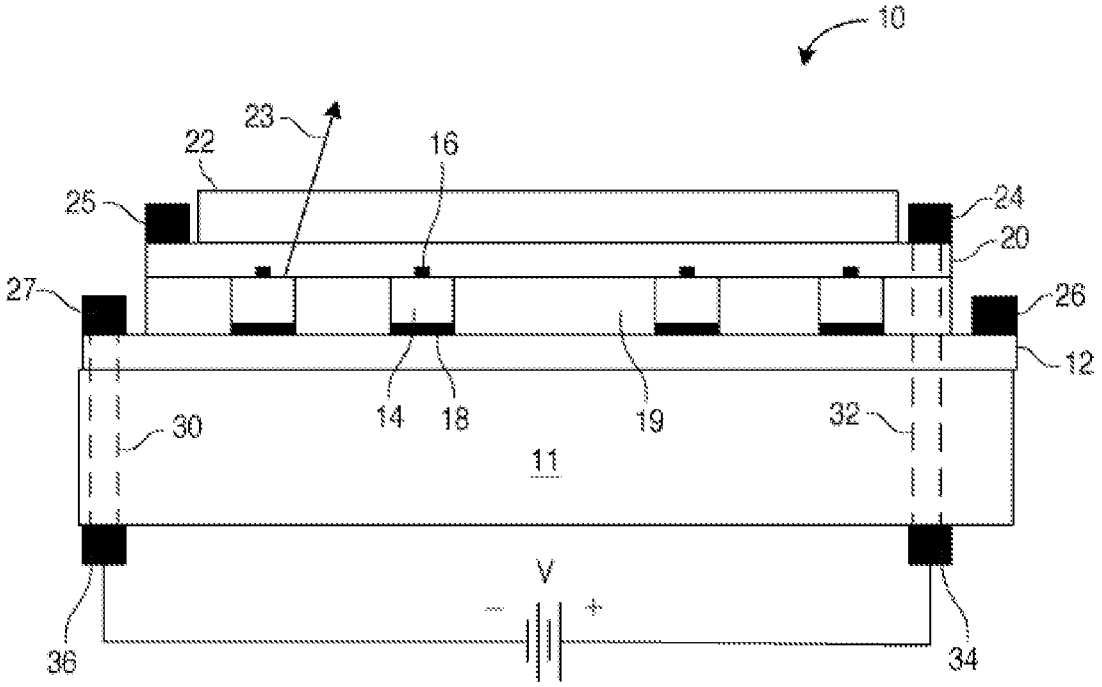
FIG. 1 is a cross-sectional view of an LED sheet portion of a target, along line 1-1 in FIG. 2, in accordance with one embodiment of the invention.
Figure 2:
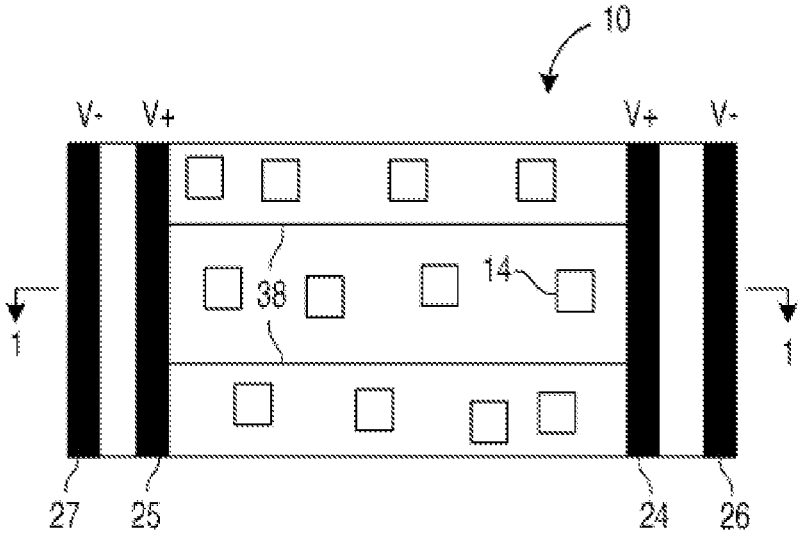
FIG. 2 is a top down view of the LED sheet portion of FIG. 1.

FIGS. 1 and 2 illustrate a small portion of such a light sheet 10 that has been customized for use either as a target or to backlight a translucent target. The size of the light sheet 10 and the pattern of printed LEDs may be customized for a particular target.

In FIG. 1, a starting substrate 11 may be any stable material that can withstand the high temperature curing temperatures during the processing. Such materials may include polycarbonate, PET (polyester), PMMA, Mylar or other type of polymer sheet, a thin metal film (e.g., aluminum), paper, cloth, or other material. In one embodiment, the substrate 11 is about 25-50 microns thick.

A conductor layer 12 is then deposited over the substrate 11, such as by printing. The substrate 11 and/or conductor layer 12 may be reflective or transparent.

The conductor layer 12 may be patterned to form pixel locations for selectively addressing LEDs within each pixel area.

A monolayer of microscopic inorganic LEDs 14 is then printed over the conductor layer 12. The LEDs 14 are vertical LEDs and include standard semiconductor GaN layers, including an n-layer, and active layer, and a p-layer. GaN LEDs typically emit blue light. The LEDs 14, however, may be any type of LED emitting red, green, yellow, infrared, ultraviolet, or other color light.

In one embodiment, the LEDs 14 have a diameter less than 50 microns and a height less than 10 microns. The number of micro-LED devices per unit area may be freely adjusted when applying the micro-LEDs to the substrate 11. A well dispersed random distribution across the surface can produce nearly any desirable surface brightness. The LEDs may be printed as an ink using screen printing, flexography, or other forms of printing. Further detail of forming a light source by printing microscopic vertical LEDs, and controlling their orientation on a substrate, can be found in U.S. Pat. No. 8,852,467, entitled, Method of Manufacturing a Printable Composition of Liquid or Gel Suspension of Diodes, assigned to the present assignee and incorporated herein by reference.

The orientation of the LEDs 14 can be controlled by providing a relatively tall top electrode 16 (e.g., the anode electrode), so that the top electrode 16 orients upward by taking the fluid path of least resistance through the solvent after printing. The anode and cathode surfaces may be opposite to those shown. The LED ink is heated (cured) to evaporate the solvent. After curing, the LEDs remain attached to the underlying conductor layer 12 with a small amount of residual resin that was dissolved in the LED ink as a viscosity modifier. The adhesive properties of the resin and the decrease in volume of resin underneath the LEDs 14 during curing press the bottom cathode electrode 18 against the underlying conductor layer 12, creating a good electrical connection. Over 90% like orientation has been achieved, although satisfactory performance may be achieved with over 75% of the LEDs being in the same orientation.

A transparent polymer dielectric layer 19 is then selectively printed over the conductor layer 12 to encapsulate the sides of the LEDs 14 and further secure them in position. The ink used to form the dielectric layer 19 pulls back from the upper surface of the LEDs 14, or de-wets from the top of the LEDs 14, during curing to expose the top electrodes 16. If any dielectric remains over the LEDs 14, a blanket etch step may be performed to expose the top electrodes 16.

A transparent conductor layer 20 is then printed to contact the top electrodes 16. The conductor layer 20 is cured by lamps to create good electrical contact to the electrodes 16. The transparent conductor layer 20 may be patterned to form addressable locations (e.g., pixels) for selectively addressing LEDs within each location.

The LEDs 14 in the monolayer, within each addressable location, are connected in parallel by the conductor layers 12/20 since the LEDs 14 have the same orientation. Since the LEDs 14 are connected in parallel, the driving voltage will be approximately equal to the voltage drop of a single LED 14.

A flexible, polymer protective layer 22 may be printed over the transparent conductor layer 20. If wavelength conversion is desired, a phosphor layer may be printed over the surface, or the layer 22 may represent a phosphor layer. The phosphor layer may comprise phosphor powder (e.g. a YAG phosphor) in a transparent flexible binder, such as a resin or silicone. Some of the blue LED light leaks through the phosphor layer and combines with the phosphor layer emission to produce, for example, white light. A blue light ray 23 is shown.

The flexible light sheet 10 of FIG. 1 may be any size and may even be a continuous sheet formed during a roll-to-roll process that is later stamped out for a particular application.

FIGS. 1 and 2 also illustrate how the thin conductor layers 12 and 20 in a single pixel area on the light sheet 10 may be electrically contacted along their edges by metal bus bars 24-27 that are printed and cured to electrically contact the conductor layers 12 and 20. The metal bus bars along opposite edges are shorted together by a printed metal portion outside of the cross-section. The structure may have one or more conductive vias 30 and 32 (metal filled through-holes), which form a bottom anode lead 34 and a bottom cathode lead 36 so that all electrical connections may be made from the bottom of the substrate 11. A suitable voltage differential applied to the leads 34 and 36 turns on the LEDs 14 to emit light through one or both surfaces of the light sheet 10. The metal bus bars 24-27 may form row and column addressing lines for lighting up only those LEDs within at the intersection of energized row and column lines. Each pixel location can be any size, depending on the desired resolution.

FIG. 2 is a top down view of the light sheet 10 of FIG. 1, where FIG. 1 is taken along line 1-1 in FIG. 2. If there is a significant IR drop across the transparent conductor layer 20, thin metal runners 38 may be printed along the surface of the conductor layer 20 between the opposing bus bars 24 and 25 to cause the conductor layer 20 to have a more uniform voltage, resulting in more uniform current spreading. In an actual embodiment, there may be thousands of LEDs 14 in a light sheet 10.

Figure 3:
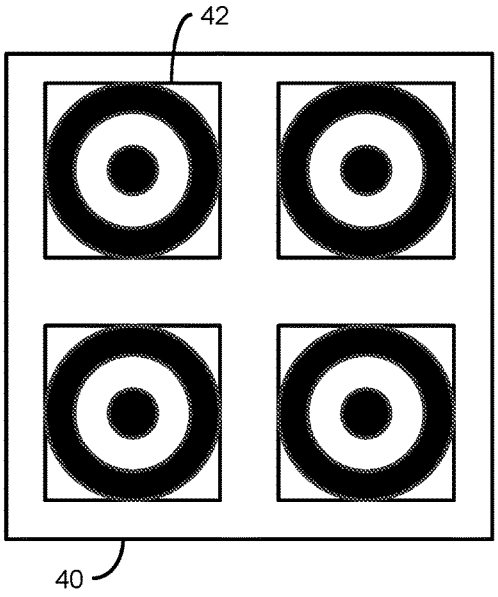
FIG. 3 is a front view of a target containing LEDs and a hit detection layer.

FIG. 3 illustrates a printed target 40. In one embodiment, the target 40 is translucent, or portions of the target are transparent, and the target is backlighted by the light sheet 10 of FIG. 4. In another embodiment, the light sheet 10 layers are printed directly on the target substrate. The target 40 illustrates four separate sub-targets 42.

Figure 4:
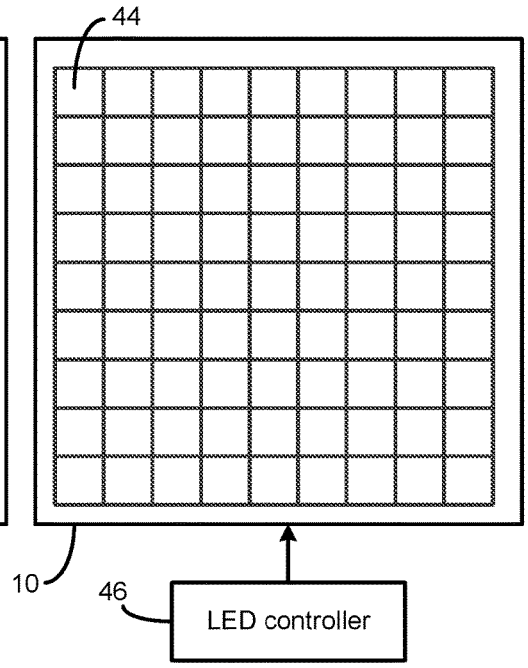
FIG. 4 illustrates an LED pixel array that backlights the target image or displays the target image.

FIG. 4 illustrates the LEDs behind the targets being addressable as pixels 44 in a grid. The resolution in an actual embodiment may be much greater or less than shown in FIG. 4. For example, the energized LED pattern may itself create the target image and dynamically change the target, or each of the four targets 42 in FIG. 3 may simply have a single large LED pixel behind it. Alternatively, the LEDs may be printed on the back surface of each target to backlight the target, and the targets may be selectively illuminated to identify the active target.

A controller 46 addresses any pixel 44 by energizing row and column lines, as previously described. The controller 46 may be the same controller that performs the hit detection function. The LEDs may be controlled to actually create the sub-target 42 images so any target image may be programmed into the system. The pixels 44 may be controlled to create a moving target, where the scoring is automatically determined based upon the projectile hole and the location of the moving target at the time the hole was detected.

The pixels 44 may be automatically controlled to highlight a new projectile hole by surrounding the hole with a ring of energized pixels.

In other embodiments, the LED light sheet 10 is optional.

Figure 5:
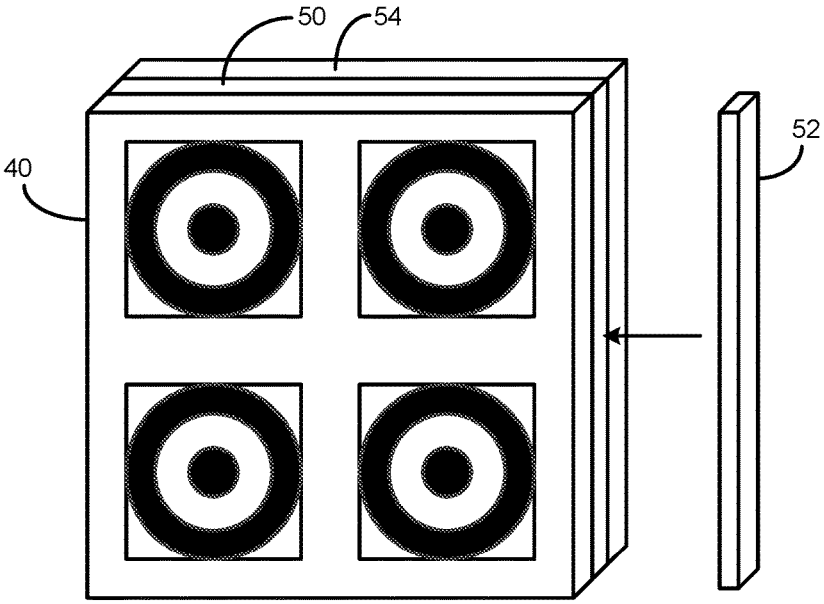
FIG. 5 illustrates various layers of the target and a technique to backlight a target using a waveguide layer.

FIG. 5 illustrates an embodiment where a transparent waveguide layer 50 is edge-lit by an LED light strip 52, which injects light into the waveguide layer 50. Light leaks out the front surface of the waveguide layer 50 to uniformly backlight each target. The front surface of the waveguide layer 50 may be roughened behind each target to leak out the light. Other LED light strips may be coupled to other edges of the waveguide layer 50 to increase the light output and more uniformly backlight the target 40. Holes in the target/backlight will be easier to see with the backlight than without the backlight.

FIG. 5 also illustrates a projectile hole detection layer 54 that electrically senses a new projectile hole and its XY position relative to the target to determine a particular score for the hit. This is referred to as a smart target. The sensed location is then transmitted to a portable device, such as a commercially available smartphone or tablet, so the shooter gets feedback in real time. In a simpler embodiment, referred to as a reactive target, the targets are relatively small, and the detection layer 54 behind the target just determines if a new hole in the target has been made, to score a maximum hit value. The system may perform additional functions, such as identifying the time between hits or identifying the time between successive hits, and transmit such information to the shooter.

Figure 6:
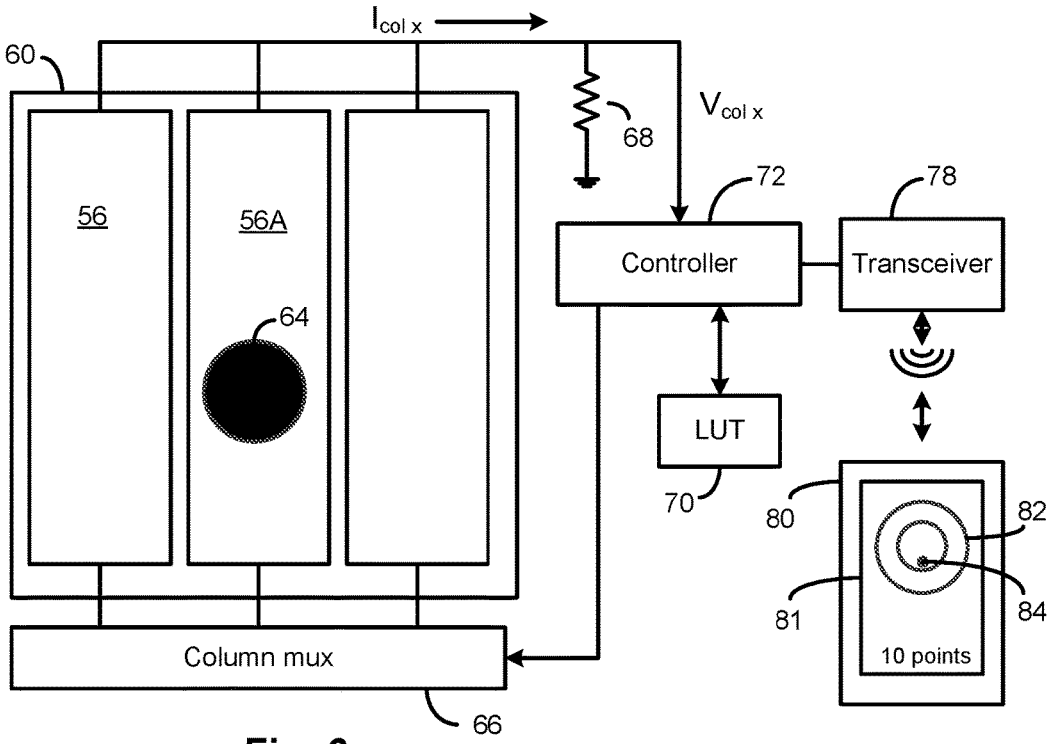
FIG. 6 illustrates resistive columns that may be used in a "smart" target to detect the location of a new projectile hole.
Figure 7:
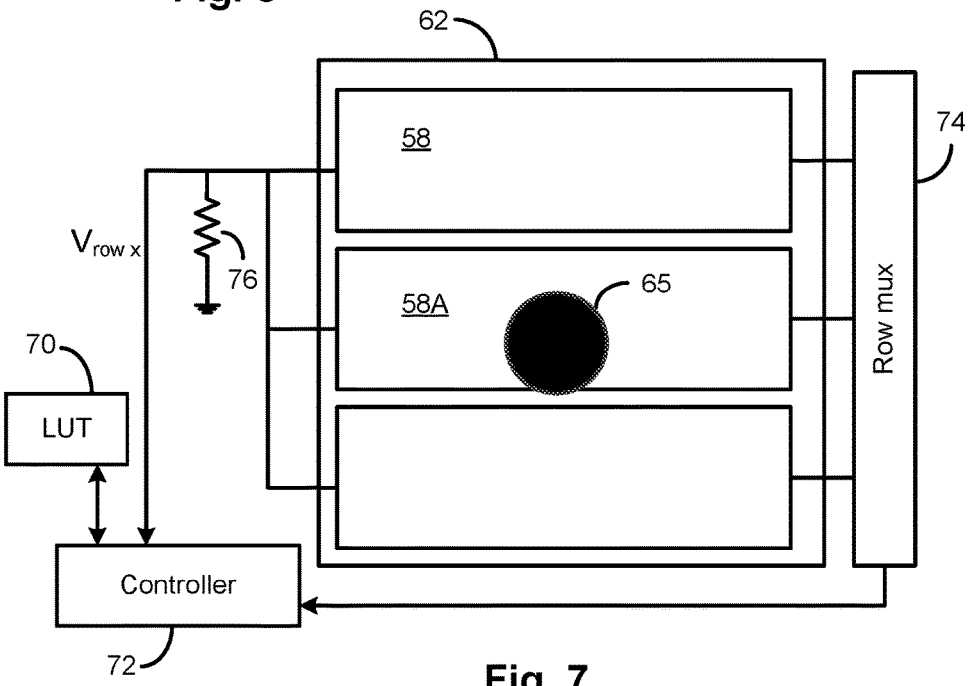
FIG. 7 illustrates resistive rows that are used in conjunction with the resistive columns of FIG. 6.

FIGS. 6 and 7 illustrate one possible "smart target" detection layer that is behind a target. FIG. 6 shows a simplified array of resistive columns 56, and FIG. 7 shows a simplified array of resistive rows 58. In an actual embodiment, there may be about 25 columns and 25 rows. The material for the columns 56 and rows 58 may be a printed carbon mixture having a well-defined resistivity. Any removal of the resistive material changes the resistance across that column and row. The array columns 56 is printed on a thin sheet 60, and the array of rows 58 is printed on another thin sheet 62 located directly above or below the sheet 60 with a dielectric layer (if needed) between the two sheets. Alternatively, the rows and columns may be printed on opposite sides of a common substrate. The change in resistance can be correlated to a particular column and row intersection.

FIGS. 6 and 7 show the same bullet hole 64/65 through a particular column 56A and a particular row 58A. The widths of the columns 56 and rows 58 are wider than a single bullet hole 64/65 so that the columns 56 and rows 58 do not become open circuits during a typical round of shooting at a single target.

In FIG. 6, a column multiplexer 66 sequentially applies a predetermined DC voltage to the columns 56 in a continuous scanning operation. Each column 56 forms a resistor divider with a fixed resistor 68 connected to ground, so that a particular column current $I_{col\ x}$ flows through the resistor 68 when the DC voltage is applied to that column, such as column 56A. The resistance of the column 56A increases when a portion of it is removed by a new bullet hole 64. This lowers the voltage drop $V_{col\ x}$ across the resistor 68 when scanning the column 56A. The previous values of voltage drops $V_{col\ x}$ for all the columns 56 are stored in a look up table 70, which is a conventional memory that may also store the program for the controller 72. When each column 56 is scanned, the controller 72 compares the newly detected $V_{col\ x}$ to the stored $V_{col\ x}$ in the look up table 70 for that column 56. If the $V_{col\ x}$ has changed greater than a threshold value, it signifies that there is a new bullet hole 64 in that column 56A. Therefore, the particular column 56 that has the new bullet hole 64 is identified.

Similarly, the rows 58 in FIG. 7 are scanned by the row multiplexer 74, and the change in resistance of a particular row 58A is detected by change in $V_{row\ x}$ across the resistor 76. The controller 72 determines the existence of a new bullet hole 65 by comparing the detected $V_{row\ x}$ to the previous voltage stored in the look up table 70. Therefore, the particular row 58 that has the new bullet hole 65 is identified. The controller 72 includes all circuitry that is required to perform the detection and processing of the hit data, including processing circuitry, memories, input/output circuits, analog-to-digital converters, etc. Multiple processors can be used for different functions, and all such processing circuitry is included in the controller 72.

An analog-to-digital converter, which may be within the controller 72, converts the analog voltage information to a digital signal for processing by the controller 72.

The XY location of the bullet hole 64/65 relative to the target is then determine based on the overlapping intersection of the column 56A and row 58A. If the bullet hole intersected two adjacent columns or rows, this characteristic change in resistance of the adjacent columns and rows is then used to identify the XY location of the bullet hole.

The XY location of the bullet hole 64/65 in the resistive layers is then mapped to the target image visible to the shooter to convey the location of the bullet hole in the target. The controller 72 may be a programmed processor that performs all the calculations.

The controller 72 then supplies the digital target hit information to an RF transceiver 78 (or a transmitter), which transmits a low power RF signal to the shooter's programmed portable device 80 such as a smartphone or tablet with a display 81. A program has been downloaded to the portable device 80 to interpret the received XY position signal and display a suitable image of the target face 82 showing the location of the new bullet hole 84. Old bullet holes may also be shown with the new bullet hole highlighted. Therefore, the shooter has feedback concerning each shot, including any shot timing information. The feedback may be in real time. The portable device 80 may also tally the shooter's score.

In another embodiment, the transceiver 78 does not transmit an RF signal but supplies the hit information to a display unit via wires, infrared signal, an acoustic signal, or other type of signal.

Instead of a fixed DC voltage, a fixed current can be used and the voltage drop across the resistive layers can be detected to detect the change in resistance.

The measured changes in voltage drops during a scan can be correlated to the XY position on the target by comparing the voltage drop changes to stored values in the look up table 70, which associate the measured voltage drop changes to the XY position. The values in the look up table 70 that associate the measured voltage drops to the XY positions may be generated by actual testing or by simulation. Alternatively, the voltage drop changes may be associated with the XY position by an algorithm carried out by the controller 72.

In another embodiment, each column has an elongated U shape (extending vertically across the entire target) with the two ends of the column being connected to the controller 72. With such a design, all the electrical connections can be made along one side of the target. Each row is also an elongated U shape.

This same technique may be used for any type of target, such as for archery or darts.

The controller 72, multiplexers 66/74, look up table 70, resistors 68/76, and transceiver 78 are connected to terminals of the detection layers by a suitable removable connector and are a permanent part of the system.

Many other techniques may be used to form the detection layers.

Figure 8:
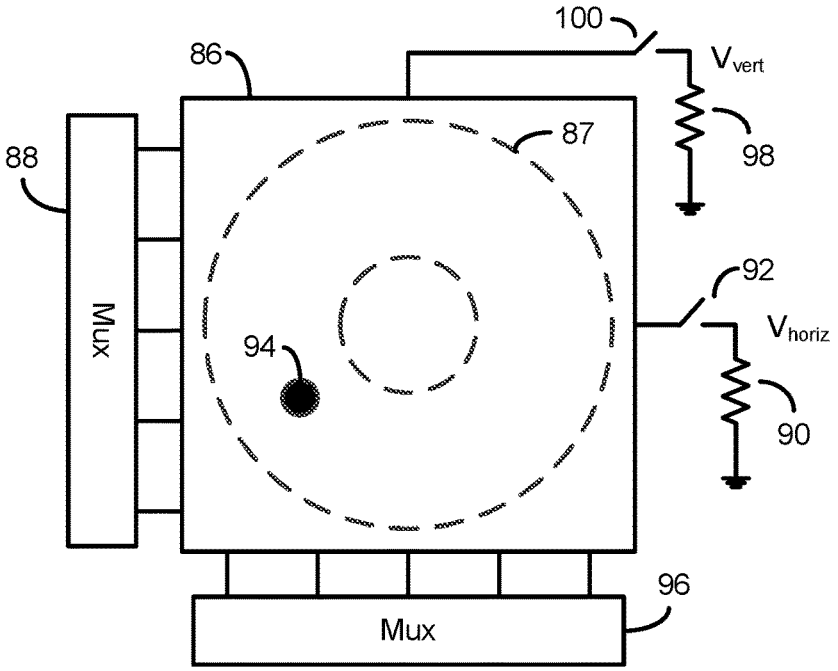
FIG. 8 illustrates another embodiment of a resistive sheet that is sensed to detect the XY location of a new projectile hole.

FIG. 8 illustrates another technique for detecting a new bullet hole position in a target. A single sheet 86 of a printed resistive material may be used. The resistive material may be deposited using other methods such as spraying. The target image 87 is superimposed on the sheet 86. A similar controller 72 and the other circuitry in FIGS. 6 and 7 are used with the sheet 86.

The multiplexer 88 scans a DC voltage along a vertical edge of the sheet 86 and detects the voltage drop $V_{horiz}$ across the resistor 90 for each scan position, while the switch 92 is closed, to measure a horizontal resistance across the sheet 86. The location of the bullet hole 94 affects the voltage drops differently, and this change in resistance can be correlated by the controller 72 (FIG. 6) to the general location of the bullet hole 94.

Another multiplexer 96 then scans a DC voltage along a horizontal edge of the sheet 86 and detects the voltage drop $V_{vert}$ across the resistor 98 for each scan position, while the switch 100 is closed, to measure a vertical resistance across the sheet 86. The location of the bullet hole 94 affects the voltage drops differently, and this change in resistance can be correlated to the general location of the bullet hole 94.

By the controller 72 (FIG. 6) detecting the change in resistance (via the horizontal and vertical voltage drops) during a scan, the XY location of the bullet hole in the sheet 86 can be determined. This XY location is then transmitted to the shooter as previously described.

Figure 9:
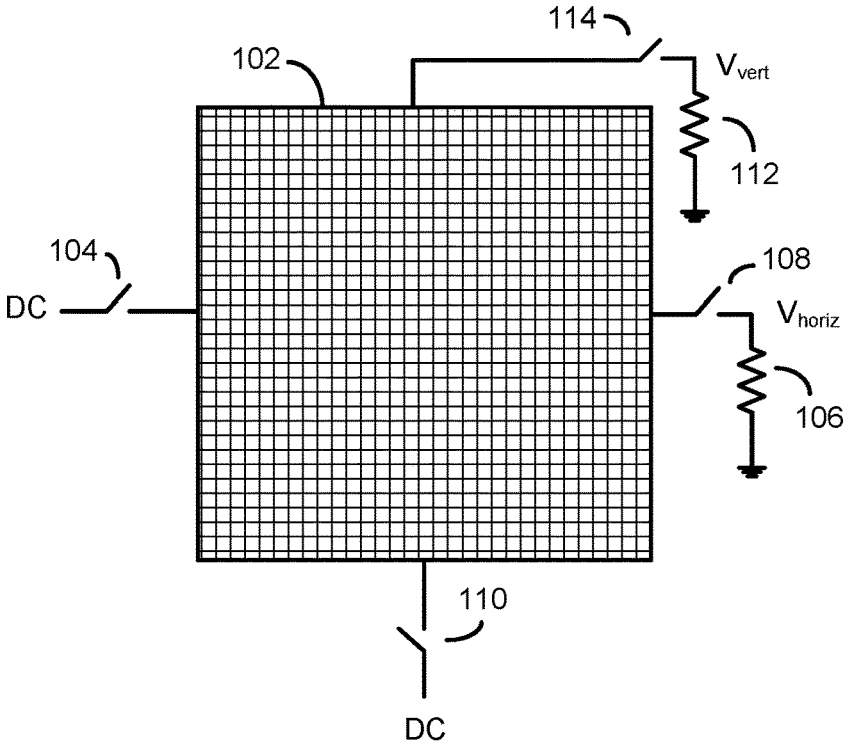
FIG. 9 illustrates a resistive mesh that is sensed to detect the XY location of a new projectile hole.

FIG. 9 illustrates another type of detection layer which is a resistive mesh 102. The mesh 102 is essentially a complex resistive network of resistors connected in series and parallel. A fixed DC voltage is applied to the vertical side of the mesh 102 via a closed switch 104, and the horizontal resistance of the mesh 102 is determine by the voltage drop $V_{horiz}$ across the resistor 106 via the closed switch 108. Then, the fixed DC voltage is applied to the horizontal side of the mesh 102 via a closed switch 110, and the vertical resistance of the mesh 102 is determine by the voltage drop $V_{vert}$ across the resistor 112 via the closed switch 114. A sufficient change in voltage drops is detected as being a new bullet hole in the mesh 102, and the particular changes in the horizontal and vertical resistances can be correlated to a particular XY location on the mesh 102. This XY location is then transmitted to the shooter as previously described.

Figure 10:
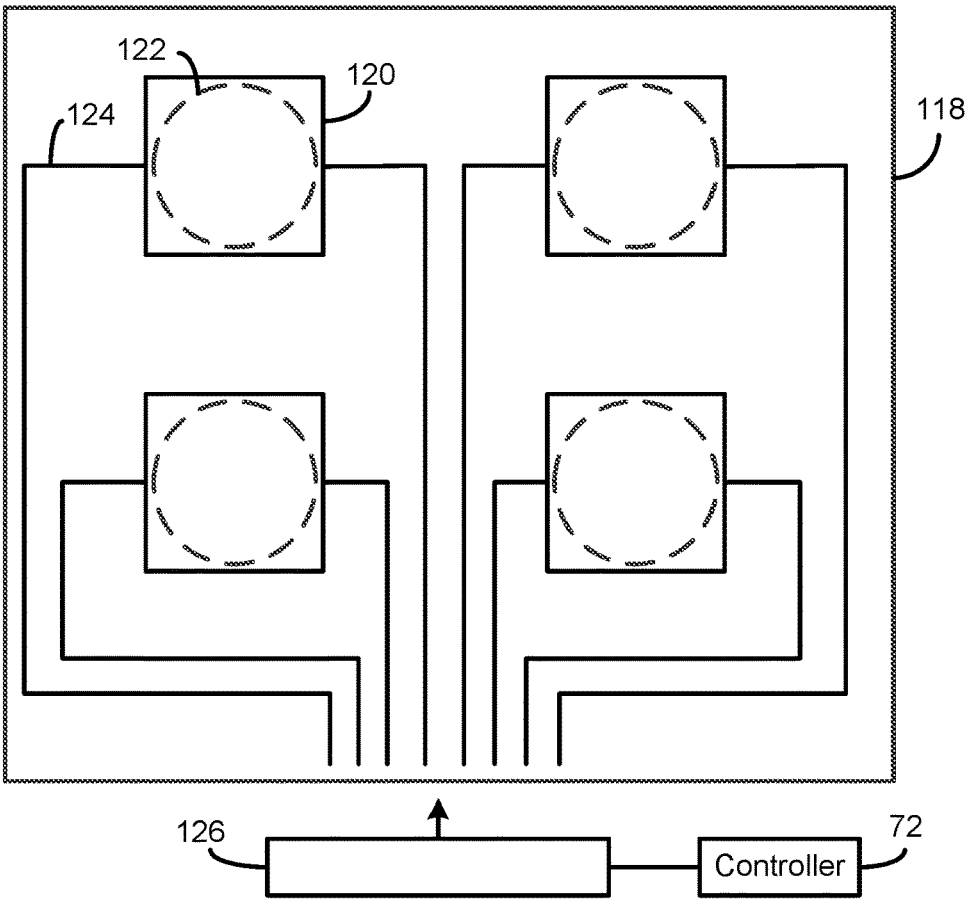
FIG. 10 illustrates an array of resistive sheets that are sensed to detect the existence of a new projectile hole.

FIG. 10 illustrates a simpler reactive target 118, where the resistive sheets 120 (or printed resistive layers on the substrate) just detect a new projectile hole formed in the target. A simple target pattern is shown in dashed outline 122. An LED sheet, with LEDs within the target boundaries, may be between the target pattern and the resistive sheets 120 to illuminate an active target. Metal traces 124 to each resistive sheet 120 extend to the bottom of the target 118 at a connection area for connection to the controller 72 for detecting the change in resistance for each resistive sheet 120. Separate pairs of traces (not shown) extend to each group of LEDs for selectively illuminating a target. A connector 126, such as a clamp connector, makes electrical contact with all the traces on the target at the connection area for connecting the traces to the controller 72.

All metal traces on the substrate in all the embodiments may be formed by depositing an aluminum layer over a dielectric substrate surface by, for example, vapor deposition or sputtering and then laser ablating the aluminum layer to leave only the traces. In one embodiment, the substrate is a thick paper with a thin PET surface layer.

In another embodiment, each concentric ring of the target face and the bullseye has its own shaped resistive sheet (e.g., in the shape of a ring) behind it that is electrically isolated from the other resistive sheets behind the target face. For example, the concentric target rings in FIG. 5 also serves to illustrate the shapes of the associated resistive sheets behind the target rings. Each ring and the bullseye has a different scoring value. In that way, simply detecting an increase in resistance of a particular one of the resistive sheets identifies the scoring for the hit. The score may then be automatically tallied and transmitted to the shooter. A particular ring of the resistive material may be discontinuous with a narrow gap between the two ends of the ring. A DC voltage is applied to one end and the current is detected at the other end to detect an increase in resistance of a particular ring to register a hit. LEDs may backlight the target face and be associated with each ring/bullseye. A hit through a particular ring/bullseye may cause that ring/bullseye to flash.

Figure 11:
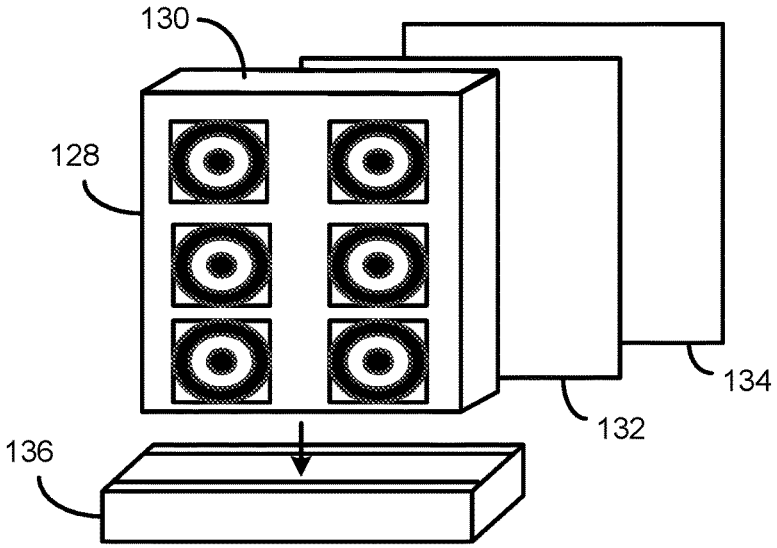
FIG. 11 illustrates the flexible, disposable target being supported by a rigid frame and the frame being inserted into a support base containing the electronics and power source.

FIG. 11 illustrates a target 128 having a printed or laminated target face backlit with an array of printed LEDs. In the example, there is an array of small targets printed on a single substrate. The flexible target 128 is mounted in a rigid frame 130. The one or more resistive layers 132 and 134, and their traces, may be separate laminated sheets or may be printed directly on the back surface of the target 128 so that the printed target face, the LEDs, the resistive layers 132/134, and all traces are printed on a single substrate, such as paper.

The bottom of the frame 130 is inserted into a support base 136, which contains a connector, all the electronics, and a battery power source (e.g., a 9 volt battery) for the target 128. When the target 128 is sufficiently damaged by the projectiles, only the target 128 is replaced.

The controller for the target 128 can be programmed to play various shooting games in a game mode. Such games include the following:

- Illuminating one of the small targets for a brief period of time as the active target, then illuminating another target as the active target. The active target must be shot before it turns off to score. If a target is hit, it will flash three times.
- All targets are initially lit to begin the game. If a target is hit, it will reduce its brightness. If a target is hit twice, it goes dark. The game is over when all targets are hit twice.
- A quick draw game entails the shooter hitting randomly lit targets. If the target is hit while it is active, the shooter scores. The time between the target becoming active and the hit may also be determined.
- Detecting times between one shooting event and another, such as determining the time between a target being lit and a hit of the target, or determining the time between successive hits of the target.
- Competitive games compare the results of one shooter to another shooter shooting at the same target or a different target.

Other games are envisioned.

Figure 12:
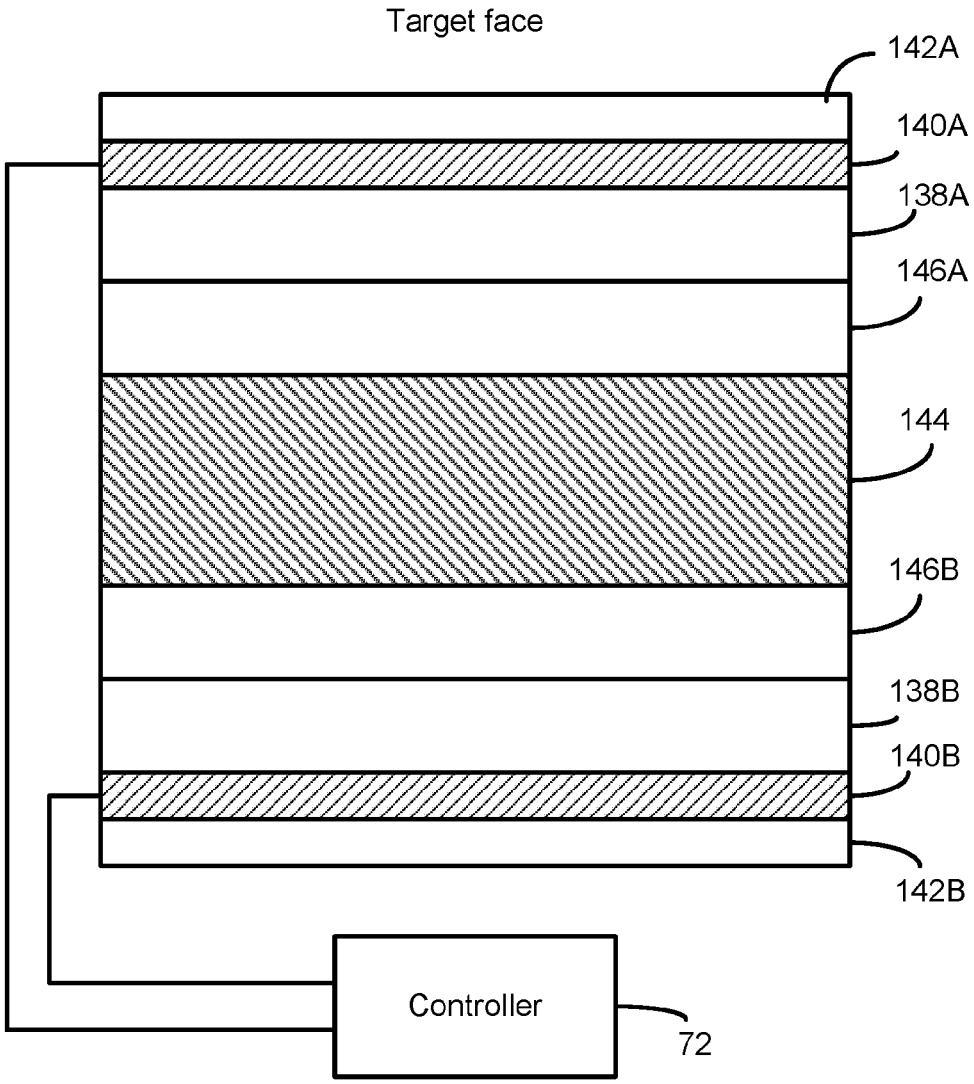
FIG. 12 is a cross-sectional view of another type of smart target where the resistive column and row lines are formed of a thin aluminum layer.

FIG. 12 is a cross-sectional view of another type of smart target where the resistive column and row lines are formed of a thin aluminum layer. PET substrates 138A and 138B have a thickness of about 50 microns. A 1000 Angstrom thick aluminum layer 140A and 140B is then vapor-deposited over the substrates 138A and 138B. Such a thin layer of aluminum is resistive. A laser then ablates away portions of the aluminum layer 140A to form column lines, similar to those shown in FIG. 6, and ablates away portions of the aluminum layer 140B to form orthogonal row lines, similar to those shown in FIG. 7. The column and row lines include diagonal lines of any angle. The laser also ablates away portions of the aluminum layer 140A and 140B to form traces leading to the controller 72 and any column multiplexer and row multiplexer, as shown in FIGS. 6 and 7. An ink-receptive and scratch resistant coating 142A and 142B is then deposited or laminated over the etched aluminum layers 140A and 140B. A target face is then printed over one or both surfaces of the coating 142A and 142B.

The bottom surfaces of the substrates 138A and 138B are then affixed to a 3-4 mm foam board 144 via a 50 micron thick adhesive layer 146A and 146B.

A bullet pierces the entire target and removes a portion of a column lines and underlying row line to increase a resistance of the two lines. A constant current source or voltage source periodically scans the column and row lines to test their resistances. The change in resistances is detected and correlated to the XY position on the target face. In one embodiment, the current or voltage source is dynamically adjusted to maintain a good signal to noise ratio.

This XY position may then be transmitted, via a WiFi signal or other RF signal, to the shooter's smartphone/tablet to visually show the location of the new bullet hole in the target and tally the score. A virtual image of the target face with the new bullet hole highlighted may be transmitted, or the programmed smartphone/tablet may create the virtual image. In another embodiment, the XY position is first transmitted to a centralized transceiver station via the 900 MHz ISM band, and the transceiver station relays the information to the shooter via WiFi.

While FIG. 12 only shows the layers used to determine the location that is struck by the projectile, one or more layers may also be present that illuminate the target face, such as the LED layer, as described elsewhere in this application.

The target system may be beneficial to the police, military, or sports shooters for simulating various events. The LEDs may be used to dynamically create target images of different objects or people.

The LEDs may be all the same color or have different colors, using different LEDs or phosphors. The LEDs can be inorganic LEDs or OLEDs. Additionally, the patterned light layer may be an electro-luminescent (EL) material. The targets may display two or more colors either simultaneously or sequentially. For example, a target that is not hit may be blue, and the target illuminates red, yellow, or green when a hit is detected.

The target may also be viewed using night vision goggles to simulate a night shooting scenario, where the target emits light that is only seen using the night vision goggles. Or, the target may be viewed using other types of goggles that detect non-visible light, such as infrared, and convert the light to a visible wavelength for viewing. In such applications, the target may employ infrared LEDs, or other LEDs that generate non-visible light, to create a specific light signature for training purposes.

Glasses with spectral filters may also be used to allow light from the target of only specific wavelengths to pass through them, thereby changing the spectrum of the light reaching the shooter's eye. This may be useful for certain applications.

Since all portions of the target may be printed on a single paper substrate, the targets can be produced inexpensively.

The targets may be used in any activity that produces a projectile hole, including holes formed by bullets, arrows, darts, etc. Therefore, the term "shooter" applies to any person or machine that launches a projectile to produce a hole in the target.

Figure 13:
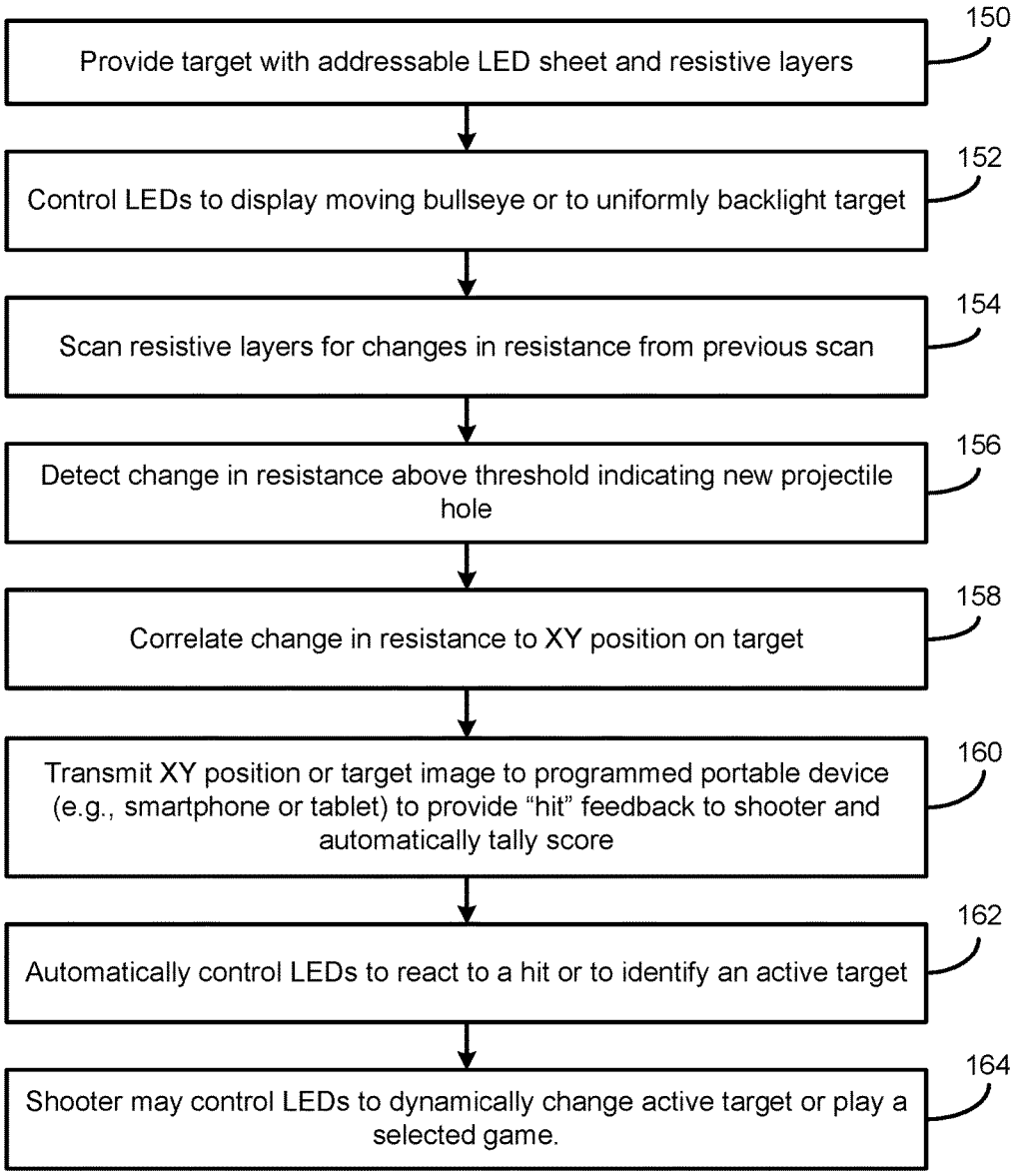
FIG. 13 is a flowchart summarizing steps performed by a "smart" target system.

FIG. 13 is a flowchart summarizing the various steps performed in one embodiment of the invention using a smart target.

In step 150, the target is provided with the addressable LEDs and the resistive layer(s).

In step 152, the LEDs are controlled to display a moving target (or bullseye) or to uniformly backlight active targets.

In step 154, a controller (e.g., a programmed microprocessor) periodically scans the resistive layers for changes in resistance since the last scan. The scan frequency may be, for example, greater than 10 Hz.

In step 156, if a new projectile hole is made in the target, the controller detects the change in resistance greater than a threshold value.

In step 158, the controller correlates the change in resistance to an XY position relative to the target face.

In step 160, the controller applies the XY position information to a transceiver (or a transmitter), and the transceiver transmits the target hit information to the shooter's portable smartphone or tablet to give the shooter real time feedback. The display screen shows an animated image of the target with the hole locations and highlights the new hole location. The portable device also tallies the shooter's score and stores the information.

In step 162, the LEDs may be controlled to react to the hit, such as by flashing or highlighting a new target.

In step 164, the shooter may use the portable device to control the LEDs in the target to highlight a different active target or play various games.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A target system comprising:

a target face viewable by a shooter, where the shooter launches a projectile at the target face to form a projectile hole in the target face;

at least one resistive layer aligned with the target face, wherein the projectile hole increases a resistance of the at least one resistive layer;

a controller detecting a first signal corresponding to the increase in resistance of the at least one resistive layer due to the projectile hole; and a transmitter for transmitting information to a receiving device to provide the shooter feedback regarding the projectile hole.

2. The system of claim 1 further comprising light emitting diodes (LEDs) that illuminate the target face.

3. The system of claim 2 wherein the LEDs backlight the target face.

4. The system of claim 2 wherein the controller controls the LEDs to highlight different areas of the target face.

5. The system of claim 1 wherein the at least one resistive layer comprises a plurality of overlapping resistive layers.

6. The system of claim 1 wherein the at least one resistive layer comprises a single resistive layer aligned with a single target.

7. The system of claim 1 wherein the resistance of the at least one resistive layer is periodically detected by the controller to detect a change in resistance relative to a previous detection of the resistance.

8. The system of claim 1 wherein the at least one resistive layer is scanned to determine a position of the projectile hole in the at least one resistive layer.

9. The system of claim 1 wherein the controller determines if the at least one resistive layer has received a new projectile hole.

10. The system of claim 1 wherein the transmitter is an RF transmitter that transmits an RF signal to the receiving device to provide the shooter feedback regarding the projectile hole.

11. The system of claim 1 wherein the target face and the at least one resistive layer are provided on a disposable flexible substrate, and the controller and transmitter are separate from the substrate and reusable.

12. The system of claim 11 wherein the controller and transmitter are located in a support base for the substrate.

13. The system of claim 1 wherein the at least one resistive layer is printed on a back surface of a substrate, and wherein the target face is on a front surface of the substrate.

14. The system of claim 1 wherein the at least resistive layer comprises:

a plurality of column lines behind the target face;

a plurality of row lines behind the target face orthogonal to the column lines and overlapping the column lines;

wherein the controller is configured to detect a new projectile hole through a particular column line and row line and thereby detect a position of the projectile hole relative to the target face.

15. The system of claim 1 wherein the at least resistive layer comprises a single resistive layer behind the target face, the resistive layer having a first edge and a second edge perpendicular to the first edge, the system further comprising:

a first scanning circuit, coupled to the controller, applying a first predetermined signal along various locations along the first edge;

a second scanning circuit, coupled to the controller, applying a second predetermined signal along various locations along the second edge;

a first detector coupled to the controller and to a third edge of the resistive layer opposite to the first edge for detecting a resistance of the resistive layer while the first scanning circuit is applying the first predetermined signal along various locations along the first edge; and a second detector coupled to the controller and to a fourth edge of the resistive layer opposite to the second edge for detecting a resistance of the resistive layer while the second scanning circuit is applying the second predetermined signal along various locations along the second edge.

16. The system of claim 15 wherein the resistive layer is a solid resistive layer.

17. The system of claim 15 wherein the resistive layer is a resistive mesh.

18. The system of claim 1 wherein the receiving device is a smartphone.

19. The system of claim 1 wherein the receiving device is a tablet.

20. The system of claim 1 wherein the controller comprises an analog-to-digital converter for converting an analog signal representing the increase in resistance of the at least one resistive layer to a digital signal for processing by the controller.

21. The system of claim 1 wherein the controller is configured to detect a time between successive projectile holes being made in the at least one resistive layer.

22. The system of claim 1 further comprising light emitting diodes (LEDs) illuminating the target face, wherein the controller is configured to detect a time between the target face being illuminated by the LEDs and when a new projectile hole is made in the target face.

23. The system of claim 1 further comprising light emitting diodes (LEDs) illuminating the target face, wherein the controller is configured to detect when a new projectile hole is made in the target face while it is illuminated by the LEDs.

24. The system of claim 1 further comprising light emitting diodes (LEDs) illuminating the target face, wherein the LEDs emit visible light.

25. The system of claim 1 further comprising light emitting diodes (LEDs) illuminating the target face, wherein the LEDs emit a wavelength of light that is not visible to the human eye.

26. The system of claim 1 wherein the at least one resistive layer comprises a separate resistive layer for each scoring value of the target face, wherein a change in resistance of a particular one of the separate resistive layers identifies a scoring value of a new projectile hole.

27. The system of claim 1 wherein the at least one resistive layer comprises a first resistive metal layer, forming a first set of lines, and a second resistive metal layer, forming a second set of lines orthogonal to the first set of lines.

28. The system of claim 27 wherein the at least one resistive layer comprises a metal layer that has been etched to form the first set of lines, the second set of lines, and traces leading to a power source.

* * * * *